US006450329B1

(12) United States Patent
Draghetti et al.

(10) Patent No.: US 6,450,329 B1
(45) Date of Patent: Sep. 17, 2002

(54) PACKET FOR A GROUP OF ARTICLES OF ELONGATED SHAPE, AND A RELATIVE METHOD OF MANUFACTURE

(75) Inventors: Fiorenzo Draghetti, Medicina; Angelo Li Vigni, Bologna, both of (IT)

(73) Assignee: G.D S.p. A., Bologna (IT)

( * ) Notice: Subject to any disclaimer, the term of this patent is extended or adjusted under 35 U.S.C. 154(b) by 0 days.

(21) Appl. No.: 09/559,752

(22) Filed: Apr. 27, 2000

(30) Foreign Application Priority Data

May 6, 1999 (IT) ..... BO99A0228

(51) Int. Cl.[7] ..... B65D 85/10
(52) U.S. Cl. ..... 206/252; 206/255
(58) Field of Search ..... 206/249, 252, 206/255, 265, 268, 271, 273, 817; 229/160.1, 87.13

(56) References Cited

U.S. PATENT DOCUMENTS

| | | | | |
|---|---|---|---|---|
| 1,957,293 A | * | 5/1934 | Reilly | 206/252 |
| 2,185,605 A | * | 1/1940 | Murphy et al. | 206/252 |
| 2,327,120 A | * | 8/1943 | McCoon | 206/252 |
| 2,331,035 A | * | 10/1943 | Lundstrom | 206/252 |
| 2,510,630 A | * | 6/1950 | Goldsworthy | 206/252 |
| 2,688,434 A | | 9/1954 | Udel | |
| 2,856,098 A | * | 10/1958 | Geisel | 206/252 |
| 3,446,338 A | * | 5/1969 | Bozyk | 206/252 |
| 5,058,739 A | | 10/1991 | Sainsbury | |

FOREIGN PATENT DOCUMENTS

| | | |
|---|---|---|
| DE | 579361 | 6/1933 |
| GB | 1 584 162 | 2/1981 |

* cited by examiner

*Primary Examiner*—Luan K. Bui
(74) *Attorney, Agent, or Firm*—The Law Offices of Timothy J. Klima

(57) ABSTRACT

A packet serving to contain a group of cigarettes appears substantially parallelepiped in shape with a predominating longitudinal axis disposed parallel to the longitudinal axes of the cigarettes, and comprises a front, a back and two flanks, also a bottom, and a top that can be opened at least in part to provide an area affording access to the inside of the packet. The cigarettes are packaged together with a fan-folded pressure element of stiff paper placed between the group and one flank, which is rendered flexible along at least one line or portion of elastic deformation and able thus to compress and expand elastically along an axis of compression and expansion normal to the axis of the packet; as a result of the tension stored in the pressure element, the cigarettes are invested with a uniformly applied pushing force and biased toward the access area whilst a similarly uniform reaction force is directed against the inside face of the flank.

23 Claims, 5 Drawing Sheets

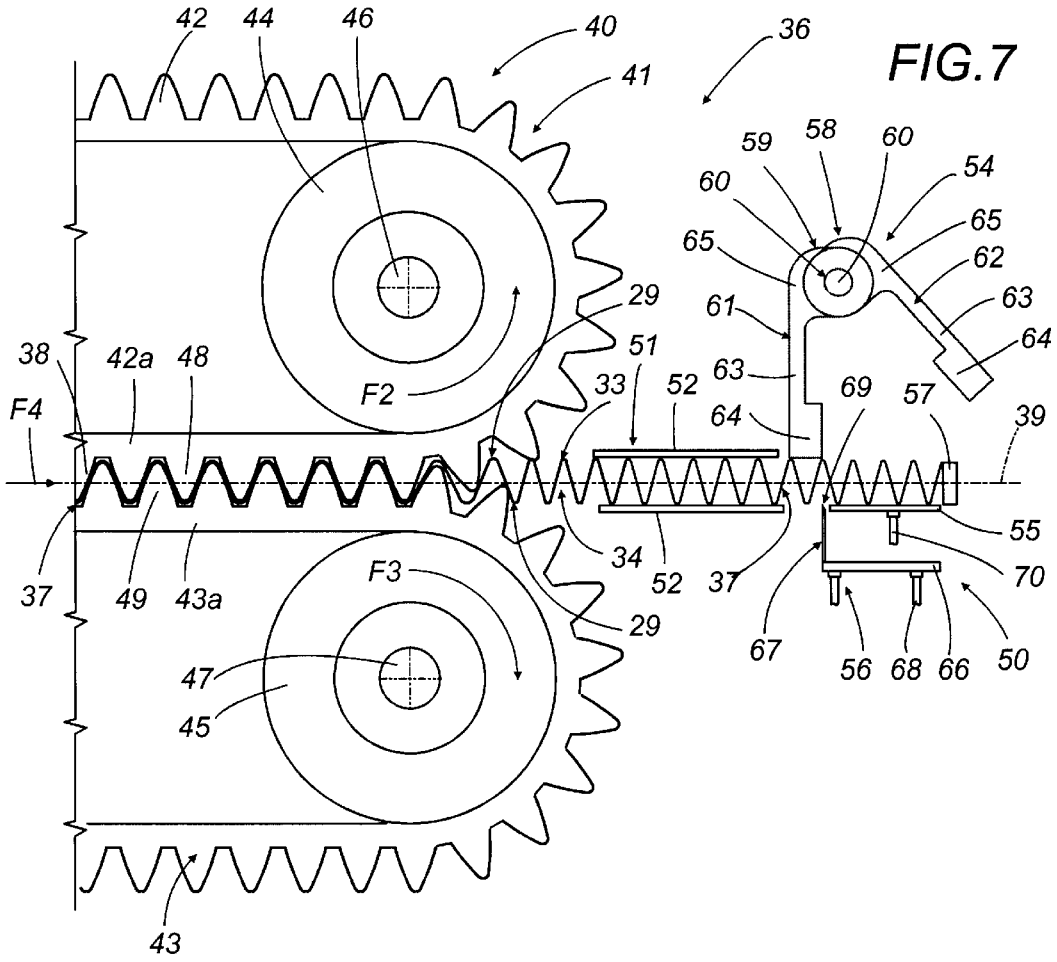
FIG.7
FIG.8
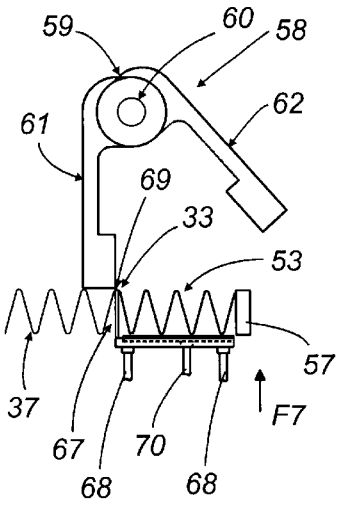
FIG.9
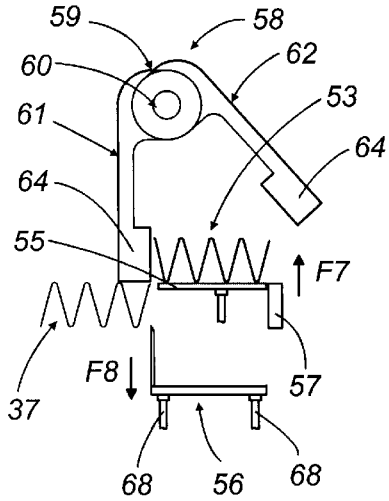
FIG.10
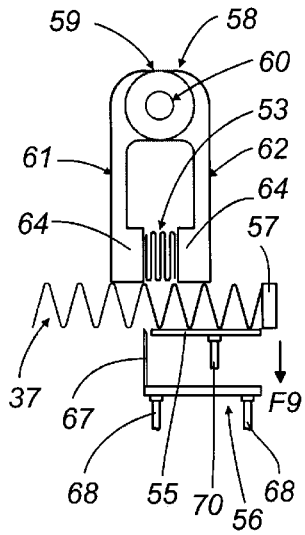

PACKET FOR A GROUP OF ARTICLES OF ELONGATED SHAPE, AND A RELATIVE METHOD OF MANUFACTURE

BACKGROUND OF THE INVENTION

The present invention relates to a packet for articles of elongated shape.

In particular, a packet according to the present invention is designed to contain a group of tobacco products consisting in cigarettes, cigars or the like, to which reference will be made throughout the specification that follows albeit implying no limitation in scope; such a packet can be either of the soft type, or the rigid type with a hinged lid.

The word "cigarettes" is used in the course of the specification to indicate an individual article or tobacco product, whilst the expression "group of cigarettes" is utilized to indicate a predetermined number of cigarettes constituting the contents of one packet and arranged in the same manner as when wrapped ultimately in the finished packet.

Generally speaking, the soft or 'crush' type of cigarette packet is substantially parallelepiped in appearance, with a predominating longitudinal axis disposed parallel to the longitudinal axes of the cigarettes, and comprises an inner wrapper usually of paper or metal foil fully enveloping a group of cigarettes, also an outer wrapper or label folded about the inner wrapper in such a way that the top face of this same inner wrapper remains exposed. Likewise, a cigarette packet of the rigid type with hinged lid appears substantially as a rectangular parallelepiped and comprises an outer wrapper of box-like embodiment fashioned as a container, with a relative lid hinged to the container. The outer wrapper accommodates an inner wrapper normally of paper or metal foil, entirely enveloping the group of cigarettes and identical in shape to the inner wrapper of the soft type of pack.

In particular, the present invention relates to a cigarette packet of the rigid type having a hinged lid, of which the container comprises a front, a back, two flanks, a bottom and a top, and presents an opening adjacent to one edge bordering the top, delimited by respective free edges cut in the top, front and back and by a transverse edge located on the flank contiguous to the opening, along which the lid is hinged.

More precisely, therefore, the invention relates to a particular cigarette packet of the rigid variety mentioned above in which, when the lid is rotated about the lateral edge afforded by one of the two flanks, the area of access afforded to the inside of the packet is notably smaller than that afforded by a traditional rigid packet having the lid hinged along a transverse edge afforded by the back of the relative container.

In the case of the aforementioned soft or crush type of packet, the area affording access to the contents is created by the smoker, who typically will tear open the inner wrapper by hand, removing a relatively small portion of the top adjoining one of the two flanks. Likewise in this instance, the area affording access to the inside of the packet is somewhat small.

Accordingly, it will be clear that as the single cigarettes are removed gradually from the packet, be it of. the soft type or the rigid type described above, the group breaks up and the cigarettes that remain inside the packet become noticeably looser, knocking one against the next, with the result that a significant quantity of tobacco filler is lost from the tips and the cigarettes themselves can be damaged on occasion not inconsiderably.

Furthermore, because the area affording access to the inside of the packet is relatively small, the cigarettes become more difficult to extract as they are taken out and smoked one by one, in as much as the cigarettes remaining inside the packet do not shift naturally toward the area of access and the smoker is forced to maneuver somewhat awkwardly in the attempt to seize and withdraw them.

Another drawback is attributable to the fact that the cigarettes remaining inside the packet tend naturally to fall sideways and therefore to assume an undesirable position, with their longitudinal axes skew in relation to the longitudinal axis of the packet and substantially parallel to a diagonal of the front and rear faces, so that the correct position of the group when assembled in full number is lost. This drawback in combination with that of the relatively small area affording access to the inside of the packet tends to make it even more difficult for the smoker to capture the remaining cigarettes, with the result that the cigarettes can be damaged still further, bending and even breaking completely. Obviously, in the attempt to lay hold on those cigarettes that have not shifted naturally into alignment with the opening, the aforementioned awkward maneuvers performed by the smoker will inevitably result in damage to the packet as well.

The object of the present invention is to provide a packet for a group of cigarettes or other tobacco products, internally of which the cigarettes stay ordered as they are removed gradually and consumed, and the cigarettes of the group remaining at any given moment are maintained in the same position as when wrapped initially, with neither the cigarettes nor the packet suffering damage, and from which the cigarettes can be removed conveniently and swiftly.

SUMMARY OF THE INVENTION

The stated object is realized according to the invention in a packet for a group of articles of elongated shape, substantially parallelepiped in. appearance with a predominating longitudinal axis disposed parallel to the longitudinal axes of the articles, comprising a front, a back, two flanks, a bottom and a top, of which at least the top is removable at least in part so as to provide an opening that coincides with an area affording access to the inside of the packet, the essential features of which are that it comprises tension means disposed internally of the packet, designed to generate a pushing force on the group such as will cause the group to shift toward the access area, and that the tension means are deformable elastically along at least one predetermined line or portion of elastic deformation.

The present invention relates also to a method of manufacturing a packet for groups of articles of elongated shape.

A method is disclosed by which to manufacture a packet for groups of articles of elongated shape, appearing substantially parallelepiped in shape with a predominating longitudinal axis disposed parallel to the longitudinal axes of the articles, comprising a front, a back, two flanks, a bottom and a top, of which at least the top is removable at least in part so as to provide an opening that coincides with an area affording access to the inside of the packet, and comprising at least one wrapper enveloping a group of the articles.

The method of manufacture in question comprises the steps of associating each group of articles with tension means deformable elastically along at least one predetermined line or portion of elastic deformation in such a way as to obtain a succession of assemblies each consisting in a relative group of articles together with respective elastically deformable tension means; enveloping each such assembly in at least one sheet of wrapping material constituting the wrapper; and in that the tension means serve to generate a pushing force on the group such as will cause the group to shift toward the access area.

BRIEF DESCRIPTION OF THE DRAWINGS

The invention will now be described in detail, by way of example, with the aid of the accompanying drawings, in which:

FIG. 7 illustrates two work stations forming part of the first portion of a packaging machine as in FIG. 5, enlarged a viewed schematically in a side elevation;

FIGS. 8, 9 and 10 are schematic side elevations illustrating a detail of FIG. 7 in a succession of operating steps;

DESCRIPTION OF THE PREFERRED EMBODIMENTS

Figure 1:
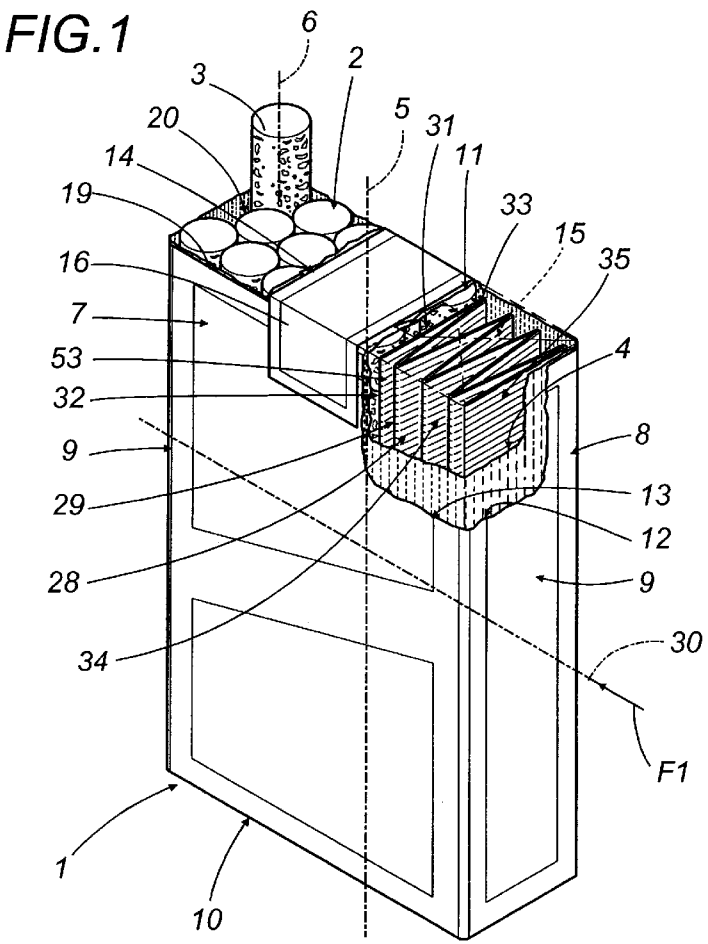
FIG. 1 illustrates a soft type of packet embodied in accordance with the present invention, viewed in perspective and with certain parts cut away.

With reference to FIGS. 1 . . . 4 of the accompanying drawings, 1 denotes a packet, in its entirety, of which the function is to contain a group 2 of cigarettes 3 fully enveloped by an inner wrapper 4 fashioned conventionally from metal foil paper. The packet 1 appears substantially parallelepiped in shape, with a predominating longitudinal axis 5 extending parallel to the longitudinal axes 6 of the cigarettes 3, and presents a front 7, a back 8, two flanks 9, a bottom 10 and a top 11.

Figure 3:
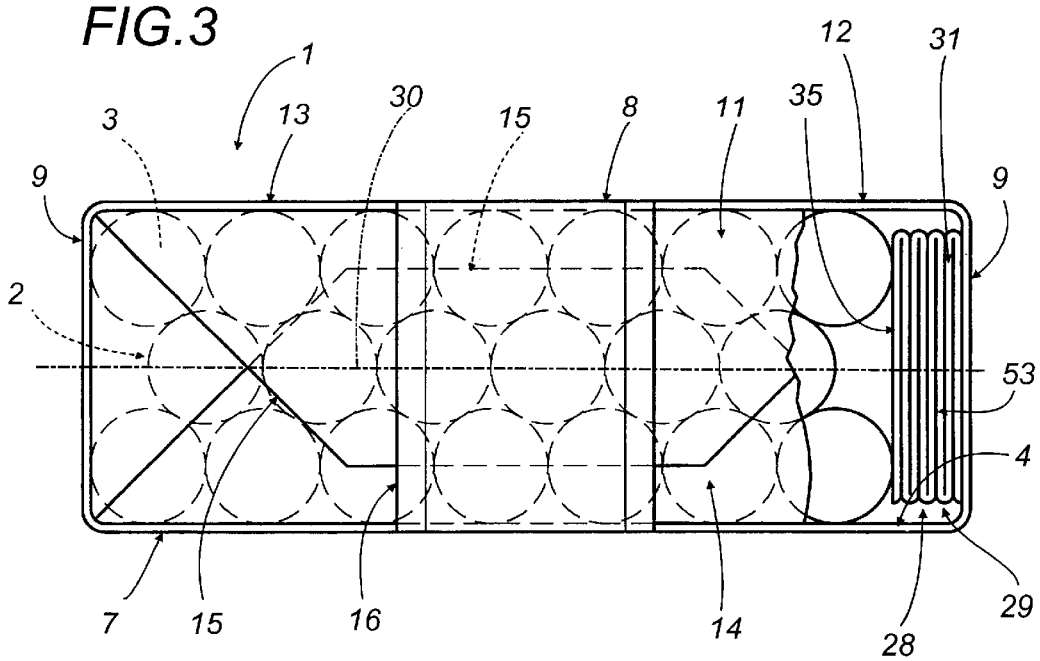
FIG. 3 shows the packet of FIG. 1 viewed in plan from above, with certain parts cut away.

In each of the packets 1 illustrated, the inner wrapper 4 is accommodated internally of an outer wrapper denoted 12; in the example of FIGS. 1 and 3 which relates to a soft type of packet 1, the outer wrapper 12 appears as a label 13 covering all of the inner wrapper 4 except for the top end face 14, which is formed by a plurality of flaps 15 folded and flattened one over another, in this instance constituting the top 11 of the packet 1. A seal 16 or manufacturing revenue stamp is applied to the top of the packet, disposed straddling the top end face 14 and affixed to the uppermost part of the front 7 and of the back 8 of the outer wrapper 12.

Figure 2:
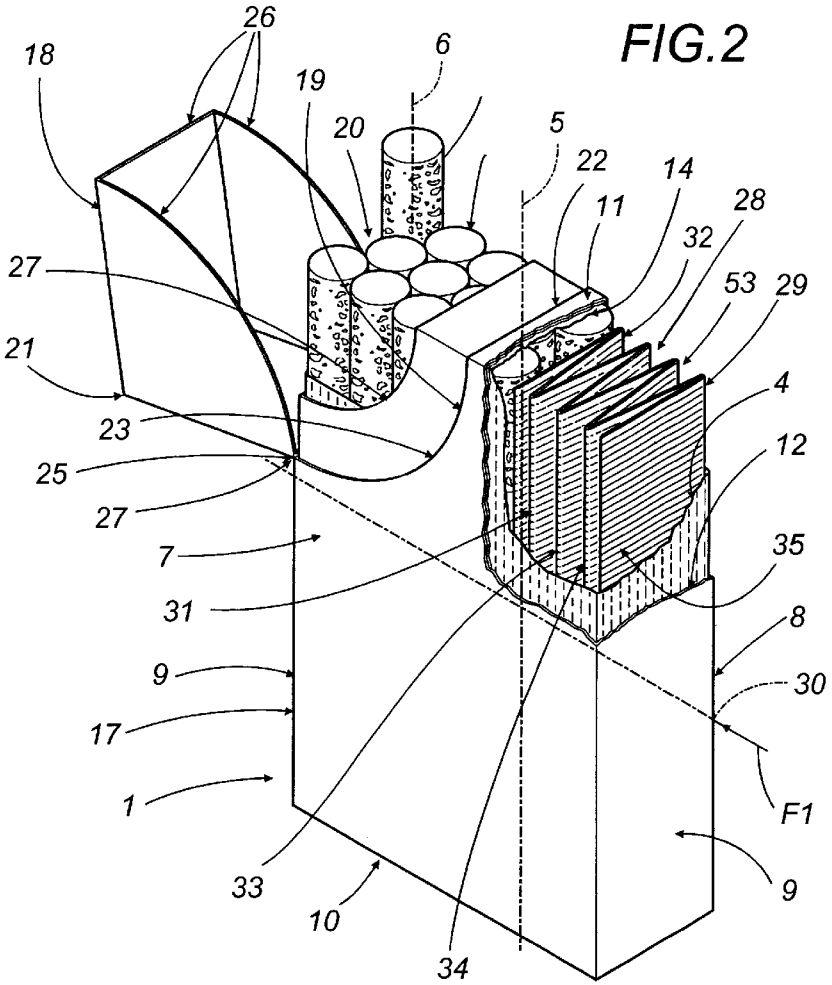
FIG. 2 illustrates a rigid type of packet with a hinged lid embodied in accordance with the present invention, viewed in perspective and with certain parts cut away.
Figure 4:
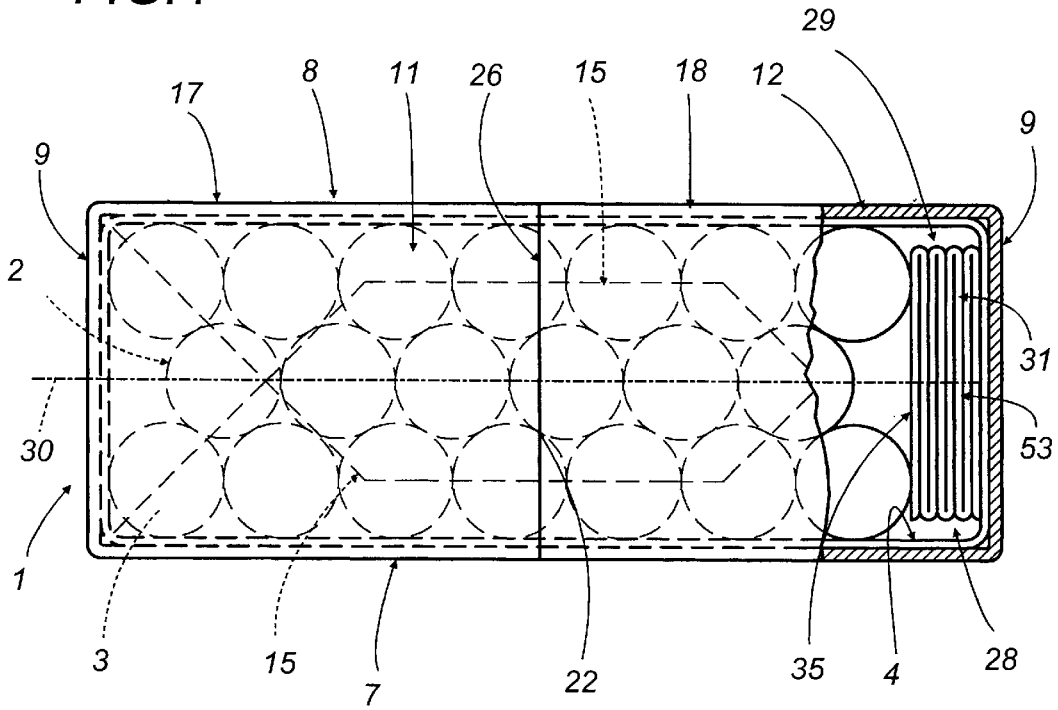
FIG. 4 shows the packet of FIG. 2 viewed in plan from above, with certain parts cut away and others in section.

In the example of FIGS. 2 and 4, which illustrate a packet 1 of rigid type, the outer wrapper 12 is fashioned as a container 17 of box-like appearance with the same front 7, back 8, flanks 9, bottom 10 and top 11, and further comprises a lid 18 hinged to the container 17.

In the packets of FIGS. 1 . . . 4, whether a packet 1 of the soft type or a packet 1 of the rigid type, the top 11 is removable in part to create an opening 19 which in turn creates an area denoted 20 affording access to the inside of the packet 1; the area 20 in question is located adjoining one or other of the two flanks 9, and relatively small in relation to the overall dimensions of the top 11.

In the case of a soft packet 1, the opening 19 is fashioned typically by the smoker, who grips one end of one of the flaps 15 constituting the top end face 14 of the inner wrapper 4 and tears off part of the material from which the flaps 15 are folded, using one edge of the seal 16 and part of the top edge of the label 13 as a guide.

In the case of the rigid type of packet 1, the opening 19 is incorporated at one corner 21 of the box-like container 17, adjacent to the top 11; in practice, the opening 19 is delimited by a first free edge 22 that extends transversely across an intermediate portion of the top 11, perpendicular to the front 7 and back 8, also by a pair of second free edges 23 (one only of which visible in FIG. 3) afforded by the front 7 and the back 8, and by a transverse third edge 24 parallel to the first free edge 22 and afforded by the flank 9 adjoining the corner 21, coinciding with a crease 25 along which the lid 18 is hinged and rendered thus rotatable between a closed position (not illustrated) and an open position (illustrated in FIG. 2).

Observing FIG. 2, the first free edge 22 and the second free edges 23 describe a continuous line that closes on the hinge crease 25 and affords a meeting edge for the free edge 26 of the lid 18 when occupying the closed position (not indicated); also, the aforementioned corner 21 of the packet coincides with the corner of the lid 18.

The rigid type of packet 1 further comprises an inner reinforcing frame 27 disposed partly inside the container 17, which is fixed to the inside surfaces of the front 7, the back 8, the flank 9 and the top 11 of the selfsame container 17.

Each of the packets 1 illustrated in FIGS. 1 . . . 4, whether of the soft type or of the rigid type, comprises tension means 28 deformable elastically by flexing on at least one predetermined line or portion 29 of elastic deformation in such a way as to be compressible and expandable elastically along an axis 30 of compression and expansion extending substantially perpendicular to the predominating longitudinal axis 5 of the packet 1, and able thus to push the group 2 of cigarettes 3 parallel with itself and with the axes 6 of the cigarettes toward the area 20 affording access to the inside of the packet 1.

Such tension means 28 consist in an elastically deformable pressure element 31 located between the group 2 of cigarettes 3 and the flank 9 remote from the opening 19. The pressure element 31 presents a substantially undulating profile developable along the axis 30 of compression and expansion mentioned previously.

Depending on the type of material from which it is made (generally paper), and on the thickness, the element 31 can present a zigzag section as in FIGS. 1 and 2, typified by a plurality of angles creating respective sharply defined edges 32 in a succession of alternating ridges 33 and troughs 34 joined together and elastically deformable along the respective lines 29 of elastic deformation, which in this instance consist of flexible fold lines coinciding with the defined edges 32, or alternatively a rippled section with ridges 33 and troughs 34 joined along respective elastically deformable portions 29 that exhibit a rounded profile, as in FIGS. 3 and 4.

In both cases the pressure element 31 consists in a series of substantially flat panels 35 combining to create the ridges 33 and troughs 34, which are joined one to the next along the aforementioned lines or portions 29 in such a way as to enable the compression or expansion of the element elastically along the axis 30 of compression and expansion, as already intimated. This same geometry, which allows the element 31 to be compacted with the panels 35 in the convoluted configuration and inserted thus into the packet 1 (as shown in FIG. 3 and FIG. 4), is instrumental in enabling it to generate a pushing force in the direction of the arrow denoted F1 in FIG. 1 and FIG. 2, along the aforementioned axis 30, applied to the group 2 uniformly and along the full longitudinal dimension of the cigarettes 3, and in like manner a substantially uniform reaction force directed against the inside face presented by the flank 9 of the packet 1.

In the example of FIGS. 1 to 4, the pressure element 31 is disposed inside the packet 1 with the lines or portions 29 parallel to the longitudinal axes 6 of the cigarettes 3, the relative panels 35 exhibiting a width dimension that is substantially identical to the transverse dimension presented by the flank 9 of the packet 1 and a length dimension that is substantially identical to the longitudinal dimension of the packet 1.

In an alternative solution, not illustrated, the pressure element 31 might be disposed internally of the packet 1 rotated through 90° about the axis 30 of compression and expansion, with the elastically deformable lines or portions 29 substantially at right angles to the longitudinal axes 6 of the cigarettes 3.

Figure 6:
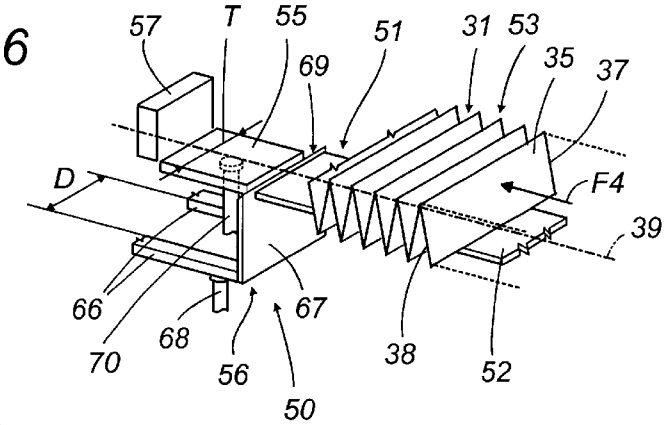
FIG. 6 is an enlarged detail of FIG. 5, illustrated schematically and in perspective.
Figure 5:
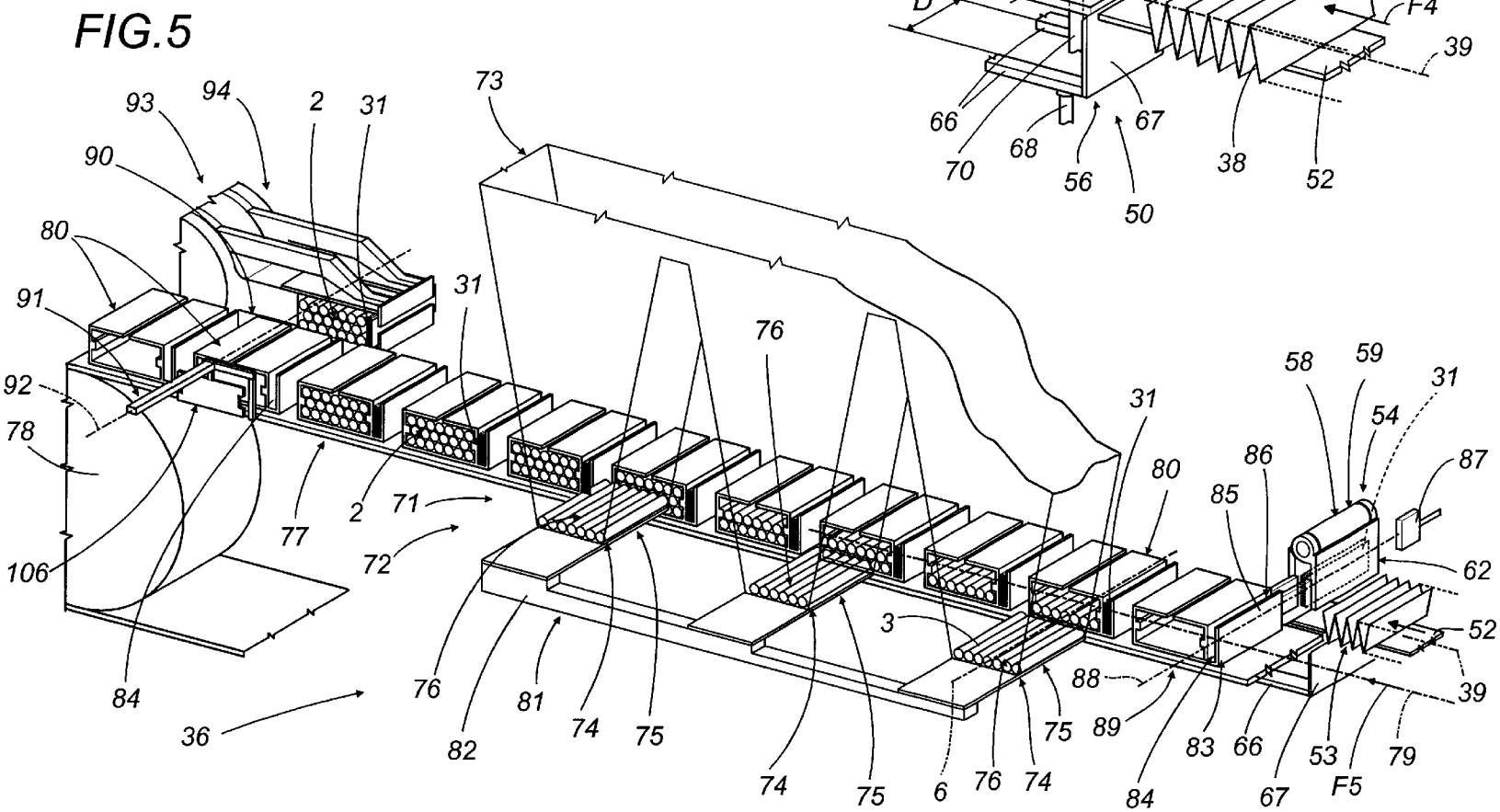
FIG. 5 illustrates a first portion of a packaging machine for manufacturing the packets of FIG. 1 and FIG. 2, viewed schematically and in perspective.

As discernible from FIGS. 5 and 6 and particularly from FIG. 7, which illustrate a first portion of a packaging machine denoted 36 in its entirety, the pressure element 31 is obtained from a continuous strip 37 of paper material 38 caused to advance along a first predetermined feed path 39 through a deforming station 40 consisting essentially in a conveyor device 41 of which FIG. 7 illustrates the runout end. The device 41 in question comprises first and second gear belts 42 and 43 disposed one on either side of the first path 39 and operating in conjunction one with another, each looped around respective pulleys 44 and 45 mounted to respective contrarotating horizontal and parallel shafts 46 and 47 which are set in motion by drive means not illustrated in the drawings. FIG. 7 shows only the pulleys 44 and 45 at the runout end of the conveyor device 41, and more exactly, a top pulley 44 over which the first belt 42 is looped and a bottom pulley 45 over which the second belt 43 is looped.

Observing FIG. 7, the two gear belts 42 and 43 are disposed with their respective teeth 48 and 49 in mesh and more exactly with the teeth 48 afforded by a bottom branch 42*a* of the first belt 42 engaging the teeth 49 afforded by a top branch 43*a* of the second belt 43, so that when the pulleys 44 and 45 are set in rotation counterclockwise and clockwise respectively, as indicated by the corresponding arrows denoted F2 and F3, the strip 37 is taken up between the sets of interlocking teeth 48 and 49 and, decoiling from a roll not illustrated in the drawings, caused to advance through the device 41 along the first feed path 39 in the direction of the arrow denoted F4.

As it advances through the station 40, the paper material 38 is creased by the teeth 48 and 49 along the lines or portions 29 of elastic deformation in such a way that the continuous strip 37 emerges at the runout end exhibiting an essentially undulating geometry, developable along the first feed path 39, characterized by a zigzag or a rippled profile composed of alternating ridges 33 and troughs 34 generated by the succession of substantially flat panels 35, which are interconnected permanently and flexibly along the respective lines or portions 29 of elastic deformation.

Still observing FIGS. 5, 6 and 7, the elastically deformed strip 37 emerges from the runout end of the conveyor device 41 and is directed beyond the deforming station 40 toward a cutting and transfer station 50, passing through a conveying channel 51 that comprises a pair of plates 52 positioned one above the other, substantially parallel and set apart at a distance such as will accommodate the strip 37 as it advances along the part of the feed path 39 separating the runout end of the conveyor device 41 from the cutting and transfer station 50.

In the example of FIGS. 6 . . . 10, the function of the station 50 is to cut the strip 37 into discrete sheets 53, each constituting a relative pressure element 31, and thereupon transfer each sheet 53 to a compacting station 54 operating in conjunction with the cutting and transfer station 50.

The cutting and transfer station 50 comprises a table 55 disposed parallel to the plates 52 of the channel 51, a cutter assembly 56, and a stationary fence 57 acting as a stop offered to the leading edge of the strip 37 deformed elastically during its passage along the first feed path 39 and toward the station 50, whilst the compacting station 54 comprises a compacting head 58, positioned above and operating in conjunction with the cutting and transfer station 50; the compacting head 58 appears as a clamp 59 carried by a pivot 60 and equipped with a first jaw 61 and a second jaw 62 hinged one relative to the other about the axis 63 of the pivot 60, which extends substantially parallel to the shafts 46 and 47 of the pulleys 44 and 45.

Each jaw 61 and 62 is substantially L-shaped when viewed in profile and comprises an arm 63 of which one free end 64 is a gripping end and the opposite end 65 is hinged on the pivot 60. More precisely, the first jaw 61 occupies a fixed position near the mouth of the channel 51, the relative free end 64 adjacent to and level with the top plate 52 and the arm 63 disposed substantially vertical, whilst the second jaw 62 is rotatable about the axis 63 of the pivot 60 (power driven by means not illustrated in the drawing) and capable thus of oscillating motion relative to the first in such a way that its free end 64 can be moved toward and away from the free end 64 of the first jaw 61.

In the example of FIGS. 6 and 7 the aforementioned cutter assembly 56 comprises a pair of rails 66 disposed parallel with one another and with the table 55. The ends of the rails 66 nearest the mouth of the channel 51 carry a blade 67 disposed parallel to the first jaw 61 in the vertical plane and substantially perpendicular to the rails 66, which are set apart at a predetermined distance D marginally greater than the transverse dimension T of the table 55 in such a way that the table 55 can pass through the space compassed by the rails 66.

The rails 66 in turn are carried by the rods 68 of two respective actuators (not illustrated, being conventional in embodiment) and capable thus of movement together with the blade 67 in a vertical direction between two limit positions: a lowered position illustrated in FIGS. 6, 7, 9 and 10, in which the upwardly directed cutting edge 69 of the blade 67 occupies substantially the same plane as the bottom plate 52 of the channel 51, making no contact with the strip 37 and allowing its passage unimpeded into the cutting and transfer station 50, and a raised position illustrated in FIG. 8, in which the blade 67 interacts with the free end 64 of the first jaw 61 as the cutting edge 69 strikes against the inside surface of a ridge 33 afforded by the strip 37 and separates a discrete sheet 53 along one of the elastically deformable lines or portions 29, thus generating a respective pressure element 31.

The table 55 similarly is supported by the rod 70 of an actuator (conventional in embodiment, and not illustrated)

and rendered capable thus of movement vertically between two limit positions: a lowered position illustrated in FIGS. 6, 7, 8 and 10, in which the table 55 occupies substantially the same plane as the bottom plate 52 of the channel S1 in order to support the elastically deformed strip 37 as it advances toward the fence 57, and a raised position (FIG. 9) in which the discrete sheet 53 cut previously by the blade 67 is positioned between the jaws of the clamp 59. The sheet 53 continues to be supported by the table 55 in the raised position until the moment when the second jaw 62 is rotated toward the first jaw 61, whereupon the sheet 53 is taken up by the free end 64 of the second jaw 62 and compacted against the free end 64 of the first jaw 61 so as to produce a convoluted configuration whereby the panels 35 are substantially breasted in contact one with the next as shown to advantage in FIG. 10.

As discernible from FIGS. 8, 9 and 10, the steps of cutting the strip 37 into sheets 53 by means of the blade 67 and transferring the cut sheet 53 to the clamp 59 through the agency of the table 55 are substantially simultaneous. In effect, the table 55 begins its upward movement in the direction of the arrow denoted F7 in FIG. 8, at the moment when the cutting edge 69 of the blade 67 strikes against the inside face of a ridge 33 and, interacting with the free end 64 of the first jaw 61, slices through the strip 37 to separate a sheet 53. At this point the table 55 and the rails 66 are aligned substantially in the same plane, as illustrated in FIG. 8, and operate in concert to transfer the sheet 53 toward the clamp 59, supporting it in a stable position throughout the upward movement. Once the sheet 53 is positioned between the jaws of the clamp 59, the cutter assembly 56 begins its downward travel in the direction of the arrow F8 in FIG. 9, whilst the table 55 pauses in the position of FIG. 9 until the sheet 53 has been compacted by the jaws 61 and 62. Once the step of compacting the sheet 53 has been completed, the table 55 begins moving downward in the direction of the arrow F9 in FIG. 10 and regains the lowered position, ready to receive the oncoming strip 37.

The cycle is repeated for each sheet 53.

Referring to FIG. 5, the first portion 36 of the packaging machine comprises a unit denoted 71 in its entirety, by which the groups 2 of cigarettes are assembled. This same unit 71 coincides with the infeed portion 72 of the machine and comprises a feed hopper 73 of conventional embodiment, of which the bottom section consists in three downwardly tapered outlets 74 each equipped internally with baffles of familiar embodiment (not illustrated) dividing the relative outlet 74 into a plurality of channels which likewise are conventional and not indicated. The cigarettes 3 are ordered in columns by the baffles and caused to drop down each channel by gravity, advancing in a direction transverse to their own axes 6. The bottom cigarette 3 of each column comes to rest on a plate 75 positioned under the relative outlet 74 at a distance marginally greater than the diameter of a single cigarette 3, so that a layer 76 of cigarettes 3 is formed on each plate 75 a short distance below the bottom of the relative outlet 74. The plates 75 in turn are located directly under the relative outlets 74 on different levels, increasing in height from right to left as viewed in FIG. 5 by an amount equivalent substantially to the diameter of one cigarette 3.

The plates 75 are flanked on one side by the top branch of a conventional belt conveyor 77 looped around at least two pulleys 78, of which one only is visible in FIG. 5, and indexed along a second feed path 79 substantially parallel to the first feed path 39 through the agency of drive means (not illustrated) coupled to one of the at least two pulleys 78. The conveyor 77 carries a plurality of pockets 80 distributed uniformly along the belt, each disposed transversely to the direction of movement followed by the top branch, indicated by an arrow denoted F5 in FIG. 5, and with an entry end facing toward the plates 75.

The conveyor 77 advances intermittently through a step of length equivalent to the distance between centers of two successive pockets 80, causing each single pocket 80 in turn to pause alongside the plates 75 and receive three successive layers 76 which are accumulated one on top of another in the pocket 80 as it passes by the hopper 73, in such a way as to form a group 2 of cigarettes 3 equal in number to the contents of one packet 1.

The step of transferring the single layers 76 to the relative pocket 80 during successive pauses of the conveyor 77 is brought about through the agency of a pusher 81 that comprises a bar 82 associated rigidly with the plates 75. The pusher 81 occupies a normally retracted at-rest position on the side of the hopper 73 remote from the conveyor 77 and is capable of reciprocating movement in a horizontal plane, generated by actuator means not illustrated in the drawing, transversely to the direction F5 followed by the conveyor 77. More precisely, the pusher 81 alternates between the retracted position and a forward position, not illustrated, in which the plates 75 occupy the corresponding pockets 80 at a height below that of the relative outlets 74.

In the example of FIG. 5, each pocket 80 is equipped with housing means 83 identifiable as an auxiliary pocket 84 consisting in a plate 85 of "L" shaped profile connected to one side of the pocket 80 and affording a compartment 86 of transverse dimensions such as will receive a relative pressure element 31 from the compacting station 54, which is positioned on the side of the belt conveyor 77 remote from the hopper 73.

The step of directing a pressure element 31 into the compartment 86 afforded by a relative auxiliary pocket 84 is performed during successive pauses of the belt conveyor 77 by a pusher 87 forming part of the compacting station 54. The pusher 87 is capable of movement horizontally in a direction normal to the direction F5 of the conveyor 77, reciprocating along a third predetermined path 88 substantially perpendicular to the first path 39 and the second path 79, by which the compacting station 54 is also connected to a positioning station 89 located along the conveyor 77.

The pusher occupies a normally retracted at-rest position on the side of the clamp 59 remote from the conveyor 77 and is reciprocated by actuator means, not illustrated. More exactly, the pusher 87 alternates between the retracted position and a forward position, not illustrated, in which its forwardmost free end occupies the space between the two jaws 61 and 62 when brought together to compact the undulated sheet 53 into a pressure element 31 ready for wrapping, with the panels 35 breasted substantially in contact. Each time an auxiliary pocket 84 occupies the positioning station 89, during successive pauses of the conveyor 77, the pusher 87 advances along the third path 88, its forwardmost free end engaging the element 31 and directing it along the third feed path 88 into the compartment 86 of the pocket 84.

As a result of the forcing action applied by the pusher 87, the packed element 31 is removed from between the jaws 61 and 62 of the clamp 59 and caused to advance along the third path 88 into the compartment 86 of the pocket 84 while temporarily motionless at the position station 89; accordingly, the group 2 of cigarettes 3 formed in each of the successive pockets 80 is accompanied by a relative pressure element 31.

As the conveyor 77 indexes along the second path 79 in the direction of the arrow F5, each assembly comprising a group 2 of cigarettes 3 and a relative element 31 advances from the positioning station 89 toward a transfer station 90 located beyond the hopper 73 in the conveying direction.

The transfer station 90 is also equipped with a pusher 91 rendered capable of movement horizontally in a direction normal to the direction F5 followed by the conveyor 77, reciprocating along a fourth predetermined path 92 substantially perpendicular to the first and second paths 39 and 79, by which the transfer station 90 is connected to a first receiving and conveying machine unit 93 operating on the side of the belt conveyor 77 remote from the transfer station 90.

Figure 11:
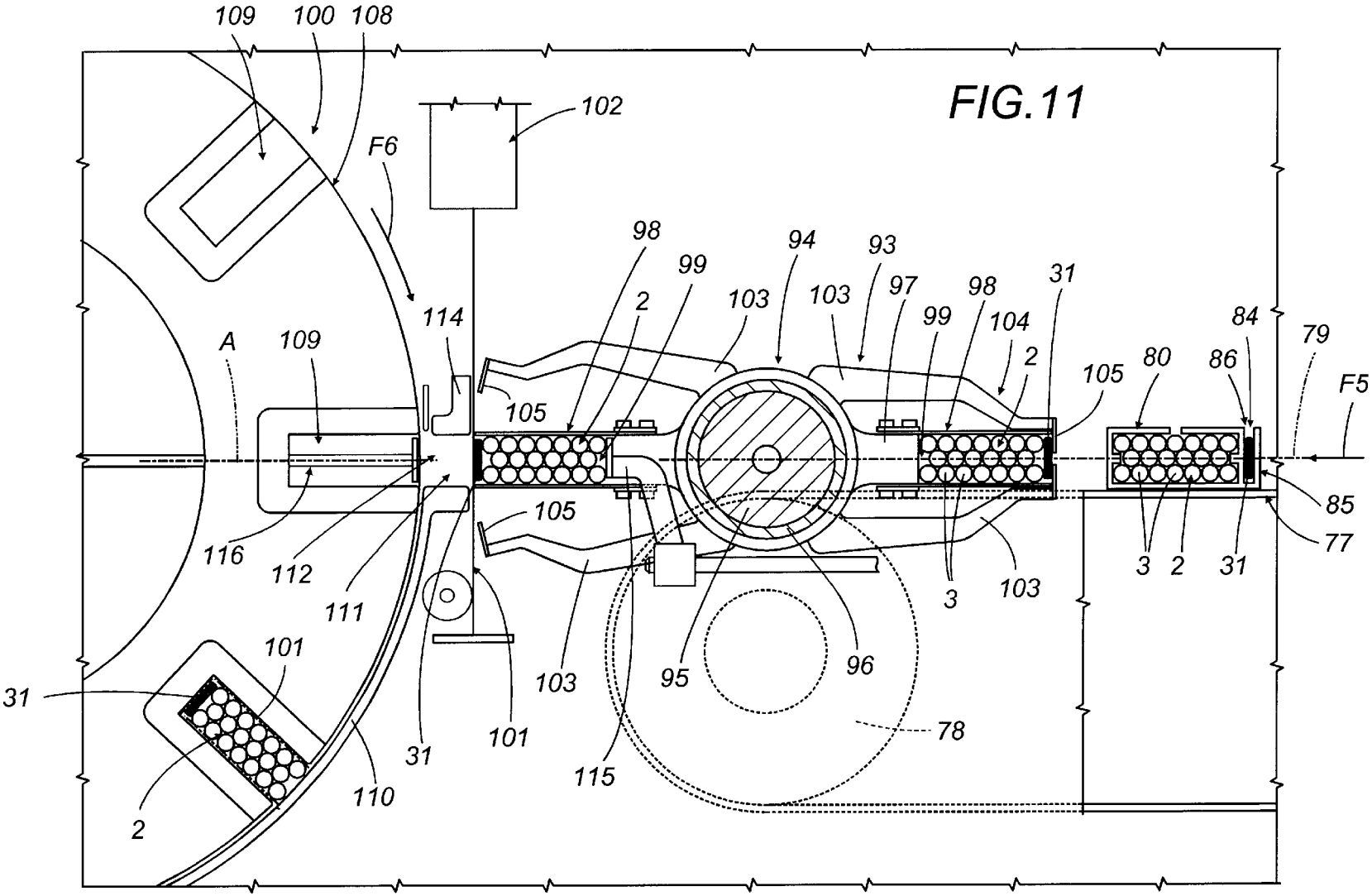
FIG. 11 illustrates a second portion of a packaging machine for manufacturing the packets of FIG. 1 and FIG. 2, viewed schematically in a side elevation.

As illustrated to better advantage in FIG. 11, the first machine unit 93 comprises a revolving head 94 supported by a fixed shaft 95 carrying a rotatable cylindrical sleeve 96 connected to a conventional drive system (not illustrated) and caused to turn about the shaft 95 through angular steps of 180°. The sleeve 96 presents two radial appendages 97 extending in diametrically opposed directions, each carrying a pair of substantially parallel leaves 98 affording a seat 99 proportioned to accommodate one assembly comprising a group 2 of cigarettes 3 and an accompanying pressure element 31. The seats 99 are rotated intermittently between diametrically opposite positions in such a way that on completion of each rotation, one seat will be aligned with the transfer station 90, occupying a loading position on the side of the conveyor 77 opposite to that occupied by the pusher 91 and offered laterally to a relative feed pocket 80 and auxiliary pocket 84, whilst the other is positioned adjacent to a second wrapping and folding machine unit 100 by which each assembly comprising a group 2 of cigarettes and a relative pressure element 31 will be enveloped in a relative sheet 101 of paper wrapping material 38; the sheets 101 are supplied by a conventional feed device indicated as a block denoted 102, located between the first machine unit 93 and the second machine unit 100 and set up in such a way as to direct the sheets 101 into a folding station 111. The sleeve 96 carries two movable arms 103 of a gripper 104 one on either side of each seat 99, supported in a conventional manner not illustrated, each equipped with a transversely disposed tip 105 by which the assembly of the group 2 and element 31 is restrained radially during the aforementioned intermittent rotation of the unit 93.

As discernible in FIG. 5, the end of the pusher 91 directed toward the pockets 80 and 84 is equipped with a plate 106 proportioned to engage the group 2 of cigarettes 3 occupying the feed pocket 80, and a finger 107 rigidly associated with the plate 106, designed to engage the element 31 occupying the auxiliary pocket 84. Thus, during the course of its aforementioned horizontal movement along the fourth feed path 92 perpendicular to the direction F5 of the belt conveyor 77, the pusher 91 will direct the assembly of group 2 and pressure element 31 into the seat 99 associated with a relative gripper 104 the revolving head 94.

Once the assembly of group 2 and element 31 has been transferred to the seat 99, the pusher 91 is returned to the retracted position of FIG. 5 and the head 94 indexes one step of 180° about the shaft 95 to bring the seat 99 into a diametrically opposite position tangential to the second wrapping and folding machine unit 100.

Observing FIG. 11, the wrapping and folding unit 100 will be seen to comprise a wrapping wheel 108 of conventional embodiment rotatable about its own axis in the direction of the arrow denoted F6. The wheel is equipped with radial pockets 109 and with a concentrically disposed cylindrical mantle 110 positioned beyond the folding station 111 in the direction F6 of rotation.

The folding station 111 consists essentially in a radial opening 112 afforded between one end of the mantle 110 and, on the side uppermost, a block 114 functioning in familiar manner as a guide against which the sheet 101 is forced. The opening 112 is associated with a pusher 115 designed to engage each assembly of group 2 and element 31 positioned alongside the folding station 111 and, with the aid of a reaction element 116 carried radially by the wrapping wheel 108, direct it from the respective seat 99 and into a vacant pocket 109 of the wheel positioned currently in alignment with the seat 99.

During this step, the group 2 of cigarettes 3 and the pressure element 31 are directed along an axis, denoted A in FIG. 5, common to the seat 99 and the pocket 109 of the wheel.

Still referring to FIG. 11, having been directed into the folding station 111 along a direction substantially perpendicular to the aforementioned common axis A, the sheet 101 assumes a position of readiness to receive the assembly of group 2 and pressure element 31, with one end held by the feed device 102 and the free opposite end located on the side of the common axis A remote from the selfsame device.

Finally, during its passage along the common axis A, the assembly of group 2 and element 31 impinges on the sheet 101 and, as the group 2 and element 31 are directed into a corresponding radial pocket 109 of the wheel 108, the sheet 101 is caused to wrap around the two components, assuming a "U" profile. Thereafter, rotating in the direction of the arrow F6, the wheel 108 performs all the familiar steps (not described) whereby the sheet 101 is wrapped around the assembly of group 2 and element 31, in such a way as to fashion the inner wrapper 4 of a packet 1 as illustrated in FIGS. 1 and 2.

What is claimed is:

1. A packet for a group of articles of elongated shape, substantially parallelepiped in appearance with a predominating longitudinal axis disposed parallel to the longitudinal axes of the articles, comprising a front, a back, two flanks, a bottom and a top, of which at least the top is removable at least in part providing an opening that coincides with an area affording access to the inside of the packet, and tension means disposed internally of the packet and generating a pushing force on the group causing the group to shift toward the access area, said tension means being deformable elastically along at least one predetermined line or portion of elastic deformation, said tension means comprising an elastically deformable pressure element having an axis of compression and expansion and having a rippled profile including a succession of alternating ridges and troughs joined together and elastically deformable along respective lines of elastic deformation, said lines of elastic deformation extending substantially parallel to the longitudinal axes of the articles of elongated shape.

2. A packet as in claim 1, of the soft type comprising an inner wrapper fully enveloping a group of the articles and an outer wrapper partly enveloping the inner wrapper with the exception of the top, said area affording access to the inside of the packet being positioned adjoining one of the two flanks and being relatively small in comparison to the total area of the top.

3. A packet as in claim 1, of rigid type with a hinged lid, comprising an inner wrapper enveloping a group of the articles and an outer wrapper enveloping the inner wrapper, said outer wrapper comprising a container and a relative lid hinged to the container along a transverse edge afforded by one of the two flanks, said area affording access to the inside of the packet being located at one corner interconnecting the top and one of the two flanks, delimited by respective free edges on the top, front and back and a transverse edge on one of the two flanks, said area being relatively small in comparison to the total area of the top and sealable by the lid.

4. A packet as in claim 1, wherein the tension means are elastically deformable along the predetermined line or portion of elastic deformation and compressible and expandable thus elastically along an axis of compression and expansion extending substantially perpendicular to the predominating longitudinal axis of the packet and substantially parallel to the front and the back.

5. A packet as in claim 1, wherein the tension means is located between the group of articles and an inside face of one flank, the elastic expansion of the tension means, along the axis of compression and expansion generating a pushing force applied to the group and distributed substantially in uniform manner along the full longitudinal dimension of the articles making up the group, also a substantially uniform reaction force being directed against the inside face presented by one flank of the packet.

6. A packet as in claim 1, wherein the rippling profile of the pressure element is defined by a succession of substantially flat panels combining to create the alternating ridges and troughs.

7. A packet as in claim 6, wherein a transverse dimension presented by each of the flat panels is substantially identical to a transverse dimension presented by the flank of the packet.

8. A packet as in claim 1, wherein a longitudinal dimension presented by each of the flat panels is substantially identical to a longitudinal dimension presented by the flank of the packet.

9. A packet as in claim 1, wherein the pressure element comprises a sheet of paper material deformed in alternate directions along the predetermined lines or portions of elastic deformation.

10. A method of manufacturing a packet for groups of articles of elongated shape, said packet appearing substantially parallelepiped in shape with a predominating longitudinal axis disposed parallel to the longitudinal axes of the articles, presenting a front, a back, two flanks, a bottom and a top, of which at least the top is removable at least in part to provide an opening that coincides with an area affording access to the inside of the packet, associating each group of articles with tension means deformable elastically along at least one predetermined line or portion of elastic deformation, thereby obtaining a succession of assemblies each forming a relative group of articles together with respective elastically deformable tension means, and enveloping each such assembly in at least one sheet of wrapping material constituting the wrapper, the tension means serving to generate a pushing force on the group causing the group to shift toward the access area.

11. A method as in claim 10, wherein the access area is positioned adjoining one of the two flanks of the packet and relatively small in comparison to the total area of the top.

12. A method as in claim 16, wherein associating each group of articles with tension means includes positioning the tension means relative to the group, such that said tension means is compressible and expandable along an axis of compression and expansion extending substantially perpendicular to the predominating longitudinal axis of the packet and substantially parallel to the front and the back.

13. A method as in claim 12, wherein the positioning includes, before enveloping each assembly in at least one sheet of wrapping material constituting the wrapper, placing the tension means in contact with the group of articles between the articles and the inside face presented by one flank of the at least one wrapper, such that elastic expansion of the tension means along the axis of compression and expansion generates a pushing force applied to the group and distributed substantially in uniform manner along the full longitudinal dimension of the articles making up the group, and a substantially uniform reaction force directed against the inside face presented by one flank of the wrapper.

14. A method as in claim 13, wherein the line or portion of elastic deformation extends substantially parallel to the longitudinal axes of the articles of elongated shape.

15. A method as in claim 13, wherein the line or portion of elastic deformation extends substantially transverse to the longitudinal axes of the articles of elongated shape.

16. A method as in claims 10, comprising the step of directing each group into a relative feed pocket caused to advance along a second predetermined feed path toward a transfer station from which each group is directed toward a first receiving and conveying machine unit, wherein the step of associating each group of articles with tension means to obtain an assembly consisting in a group of articles and respective tension means includes the steps of positioning the respective tension means internally of housing means accompanying each feed pocket, and, on arrival at the transfer station, directing each group together with the respective tension means into the first receiving and conveying machine unit as an assembly of which the group and the respective tension means are disposed in contact one with another.

17. A method as in claim 16, wherein the step of enveloping each assembly in at least one sheet of wrapping material includes the step of directing each group together with the respective tension means, by means of the first receiving and conveying machine unit, into a second wrapping and folding machine unit by which at least one sheet of wrapping material is folded around the assembly to form a relative wrapper.

18. A method as in claims 10, wherein tension means comprise at least one elastically deformable pressure element presenting a substantially undulating section developable along the axis of compression and expansion.

19. A method as in claim 18, wherein the step of associating each group of articles with tension means to obtain an assembly includes the steps of deforming a paper material elastically along the predetermined lines or portions of elastic deformation to obtain a pressure element, directing the pressure element along a first predetermined feed path toward a station at which the deformable element is compacted along the axis of compression, and directing the compacted element along a third predetermined feed path toward a positioning station where it is placed alongside a respective group of articles.

20. A method as in claim 19, wherein the elastic deformation step includes the steps of procuring a paper material from a continuous strip directed along the first path through a station at which the strip is deformed along the lines or portions of elastic deformation and emerges presenting the substantially undulating geometry, feeding the deformed strip along the first path toward a cutting and transfer station at which it is divided into discrete sheets each constituting a relative pressure element, and transferring each successive pressure element into the compacting station.

21. A method as in claim 20, wherein the step of cutting the undulated strip to obtain discrete sheets each constituting a pressure element and the step of transferring the pressure element into the compacting station are implemented substantially in simultaneous manner.

22. A method as in claim 18, wherein the pressure element presents a substantially undulating section typified by a rippled profile appearing as a succession of alternating ridges and troughs joined together and elastically deformable along respective lines of elastic deformation extending substantially parallel to the longitudinal axes of the articles of elongated shape, thus rendering the element compressible and expandable elastically along the axis of compression and expansion.

23. A method as in claim 18, wherein the pressure element presents a substantially undulating section typified by a zigzag profile appearing as a plurality of angles in a succession of alternating ridges and troughs joined together and elastically deformable along respective lines of elastic deformation extending substantially parallel to the longitudinal axes of the articles of elongated shape and coinciding with the angles, thus rendering the element compressible and expandable elastically along the axis of compression and expansion.

* * * * *